US009157393B2

(12) United States Patent
Fulton et al.

(10) Patent No.: US 9,157,393 B2
(45) Date of Patent: Oct. 13, 2015

(54) MULTI-STAGED FUEL RETURN SYSTEM

(75) Inventors: Brien Lloyd Fulton, West Bloomfield, MI (US); Brad Allen Brown, Leonard, MI (US); Carlos Armesto, Canton, MI (US); Larry Castleberry, Detroit, MI (US); Scott J. Szymusiak, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 634 days.

(21) Appl. No.: 13/309,478

(22) Filed: Dec. 1, 2011

(65) Prior Publication Data

US 2012/0216778 A1 Aug. 30, 2012

Related U.S. Application Data

(60) Provisional application No. 61/447,533, filed on Feb. 28, 2011.

(51) Int. Cl.
*F02M 37/22* (2006.01)
*F02D 41/38* (2006.01)
(Continued)

(52) U.S. Cl.
CPC ..... *F02D 41/3854* (2013.01); *F02D 41/064* (2013.01); *F02M 63/0225* (2013.01); *F02D 41/3845* (2013.01); *F02D 41/3863* (2013.01)

(58) Field of Classification Search
CPC ... F02M 31/16; F02M 37/00; F02M 31/0011; F02M 37/221; F02M 37/0047; F02M 37/16; F02M 37/20; F02M 37/22; F02M 31/125; F02M 37/0052; F02M 53/02; F02M 55/00; F02M 59/06; F01P 11/20; F02N 19/04; F02B 3/00; F02B 3/06; B01D 17/00; B01D 35/18; B01D 35/147; F02D 33/006; F02D 41/3863; F02D 41/3872; G05D 23/1366
USPC ..... 123/41.08, 41.1, 299, 300, 304, 445, 123/456, 457, 464, 467, 497, 514, 530, 535, 123/538, 549, 557, 558, 568.22, 568.31, 123/576, 578; 165/7, 201, 202, 219, 220, 165/221, 247, 253, 259, 276, 279, 280, 287, 165/288, 294, 300, 104.28, 108, 132; 285/41, 187; 60/303; 417/19, 292, 366
See application file for complete search history.

(56) References Cited

U.S. PATENT DOCUMENTS 2,125,875 A * 8/1938 Barnard ..... 44/459
4,411,240 A * 10/1983 Kravetz ..... 123/557
4,481,931 A * 11/1984 Bruner ..... 123/557
(Continued)

*Primary Examiner* — Lindsay Low
*Assistant Examiner* — John Bailey
(74) *Attorney, Agent, or Firm* — James Dottavio; Alleman Hall McCoy Russell & Tuttle LLP

(57) ABSTRACT

A fuel system for an engine is provided herein. According to one embodiment, the fuel system includes a fuel supply coupled to a low pressure fuel pump, the low pressure fuel pump coupled to a high pressure fuel pump to provide fuel to a fuel rail. Further, the fuel system includes a plurality of injectors coupled to the fuel rail to provide fuel to a plurality of engine cylinders. Further still, the fuel system includes a first fuel return line coupling the fuel rail to the fuel supply and a thermal recirculation valve, the thermal recirculation valve further coupled to a low pressure pump intake line; a second fuel return line coupling the high pressure fuel pump to the first fuel return line; and a third fuel return line coupling the plurality of injectors to a high pressure pump intake line.

18 Claims, 3 Drawing Sheets

(51) Int. Cl.
*F02D 41/06* (2006.01)
*F02M 63/02* (2006.01)

(56) References Cited

U.S. PATENT DOCUMENTS

| | | | | | |
|---|---|---|---|---|---|
| 4,491,120 | A * | 1/1985 | Hodgkins | 123/557 |
| 5,085,198 | A * | 2/1992 | Bartlett et al. | 123/510 |
| 5,269,276 | A * | 12/1993 | Brown | 123/514 |
| 5,322,624 | A * | 6/1994 | Rogers et al. | 210/232 |
| 5,794,598 | A * | 8/1998 | Janik et al. | 123/514 |
| 5,832,903 | A * | 11/1998 | White et al. | 123/514 |
| 5,887,572 | A * | 3/1999 | Channing | 123/514 |
| 5,964,206 | A * | 10/1999 | White et al. | 123/541 |
| 6,058,912 | A * | 5/2000 | Rembold et al. | 123/516 |
| 6,234,151 | B1 | 5/2001 | Eck | |
| 6,398,119 | B1 * | 6/2002 | Duffer et al. | 236/93 A |
| 6,615,806 | B2 * | 9/2003 | Schueler | 123/514 |
| 6,752,130 | B2 * | 6/2004 | Schueler et al. | 123/514 |
| 6,817,841 | B2 | 11/2004 | Frank et al. | |
| 7,040,299 | B2 * | 5/2006 | Dickerson | 123/510 |
| 7,051,699 | B2 * | 5/2006 | McGee et al. | 123/295 |
| 7,318,414 | B2 * | 1/2008 | Hou | 123/458 |
| 7,775,191 | B2 * | 8/2010 | Hou | 123/458 |
| 7,793,642 | B2 | 9/2010 | Yonemoto et al. | |
| 7,827,966 | B2 | 11/2010 | Narisako et al. | |
| 7,954,477 | B2 * | 6/2011 | Gruber et al. | 123/514 |
| 2002/0078929 | A1 * | 6/2002 | Schueler | 123/464 |
| 2003/0209232 | A1 * | 11/2003 | Hou | 123/459 |
| 2005/0241622 | A1 * | 11/2005 | Dickerson | 123/510 |
| 2006/0048757 | A1 * | 3/2006 | Harvey | 123/516 |
| 2007/0062494 | A1 * | 3/2007 | Yanagi et al. | 123/514 |
| 2008/0173280 | A1 * | 7/2008 | Hou | 123/457 |
| 2009/0283074 | A1 * | 11/2009 | Narisako et al. | 123/497 |
| 2011/0023832 | A1 * | 2/2011 | Brown et al. | 123/456 |

* cited by examiner

MULTI-STAGED FUEL RETURN SYSTEM

CROSS REFERENCE TO RELATED APPLICATION

This application claims priority to U.S. Provisional Application No. 61/447,533, filed Feb. 28, 2011, and titled MULTI-STAGED FUEL RETURN SYSTEM, the entirety of which is incorporated herein by reference for all purposes.

BACKGROUND AND SUMMARY

Many diesel engines require both a higher pressure fuel system and a lower pressure fuel system to supply fuel for engine operation and return it back to the fuel tank. The lower pressure fuel system supplies fuel to the higher pressure fuel system, at the desired pressure, temperature, quantity and quality (cleanliness and water free), which in turn pressurizes that fuel and supplies that fuel to the engine. The lower pressure fuel system has another function; it returns unused fuel from the high pressure fuel system back into the low pressure fuel system and tank. In a higher pressure fuel system, the majority of fuel is used by the engine for combustion; however, portions of the fuel are used to cool and lubricate the high pressure pump, to actuate the high pressure engine fuel injectors, and to regulate the rail pressure via opening and closing of a control valve that is hydraulically connected to the high pressure fuel in the fuel rail. The fuel that is used for these purposes is not consumed and must be returned back into the lower pressure fuel system via a return fuel system, including return lines and ducts coupled to the lower pressure fuel system.

Several problems may arise in such a system. For example, if the injector return fuel pressure (back pressure) is not maintained, (i.e. falls below a minimum pressure) the hydraulic actuators in the injectors may collapse, keeping the injectors from actuating. The loss of the ability to inject can result in a no start or long extended cranks during cold start of the engine or poor to no operation on an already running engine. Further, return fuel may include engine debris from manufacturing and other sources, which can block the fuel lines and damage fuel pumps. Furthermore, gelling or waxing of cold fuel may block fuel lines, especially at fuel filters and fuel pumps, thus decreasing fuel supply pressure and quantity which can degrade engine performance and damage the high pressure fuel pump due to lack of lubrication. Further still, if the return pressure is too high (i.e. rises above a maximum pressure) because of blockage in the return line, the seals on the high pressure pump and/or the low pressure pump may be destroyed. Other problems that may arise include, a lack of prompt draining of a water in fuel (WIF) reservoir and changing of one piece fuel filters, which include the housing, may cause contamination of the fuel system, and the fuel system may run-dry or have air ingestion during plant priming.

One approach to address the above described problems is a multi-staged fuel return system. A multi-staged fuel return system may comprise: a fuel supply; a low pressure fuel pump coupled to the fuel supply; a first fuel filter disposed between the low pressure fuel pump and the fuel supply, the first fuel filter having a first filtration size (e.g., pore size) and being disposed a WIF reservoir with a WIF sensor; a high pressure fuel pump; a second fuel filter disposed between the high pressure fuel pump and the low pressure fuel pump, the second fuel filter having a second filtration size, the second filtration size finer than the first filtration size (e.g., pore size); a common fuel rail downstream of the high pressure fuel pump; a pressure control valve coupling the common fuel rail to a first fuel return line, the first fuel return line directing return fuel to either of the fuel supply, and a region of a low pressure fuel pump intake line, which is upstream of the first fuel filter; a second fuel return line, the second fuel return line directing return fuel from the high pressure pump to the first fuel return line; a plurality of injectors coupled to a third fuel return line, the third fuel return line directing return fuel to a region of a high pressure pump intake line between the low pressure fuel pump and the high pressure fuel pump, which is upstream of the second fuel filter.

Using the system described above, return fuel may be directed to multiple locations in a lower pressure fuel system (region upstream of the high pressure fuel pump), the fuel supply, and to the high pressure pump. In this way, fuel pressure at the various locations within the system may be more tightly regulated. Further, the system takes advantage of the heat of the return fuel to decrease gelling/waxing of fuel in fuel lines, fuel filters, and fuel pumps, and excessively hot fuel may also be diverted back to the fuel supply to mix with colder bulk fuel to prevent fuel over-temperature from damaging fuel system components. Furthermore, when cold starting the engine, initiating the pressure supplied by the low pressure fuel pump to the injector return line improves cold start performance and operation of the vehicle by providing stable pressurized fuel to the return side of the fuel injector, quickly inflating the hydraulic actuators allowing them to run quickly and consistently. Further still, the described system improves protection against contamination of the fuel system from engine debris, which could potentially cause pump failures. Additionally, high pressure that may prevent damage to pump seals can be relieved by having multiple return paths, the WIF sensor indicates when the WIF reservoir need to be drained and protects fuel from contamination during changing of the filter, and imparting low pressure pump fuel pressure on injectors enables faster air bleed during plant priming.

In another example, a multi-staged fuel return system may comprise: a fuel supply; a low pressure fuel pump coupled to the fuel supply; a first fuel filter disposed between the low pressure fuel pump and the fuel supply; a high pressure fuel pump; a second fuel filter disposed between the high pressure fuel pump and the low pressure fuel pump; a common fuel rail downstream of the high pressure fuel pump; a pressure control valve coupling the common fuel rail to a first fuel return line, the first fuel return line directing return fuel to either of the fuel supply and a low pressure fuel pump intake line at a location upstream of the first fuel filter; a plurality of injectors coupled to a second fuel return line, the second fuel return line directing return fuel to a high pressure pump intake line at a location upstream of the second fuel filter.

It should be understood that the summary above is provided to introduce, in simplified form, a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
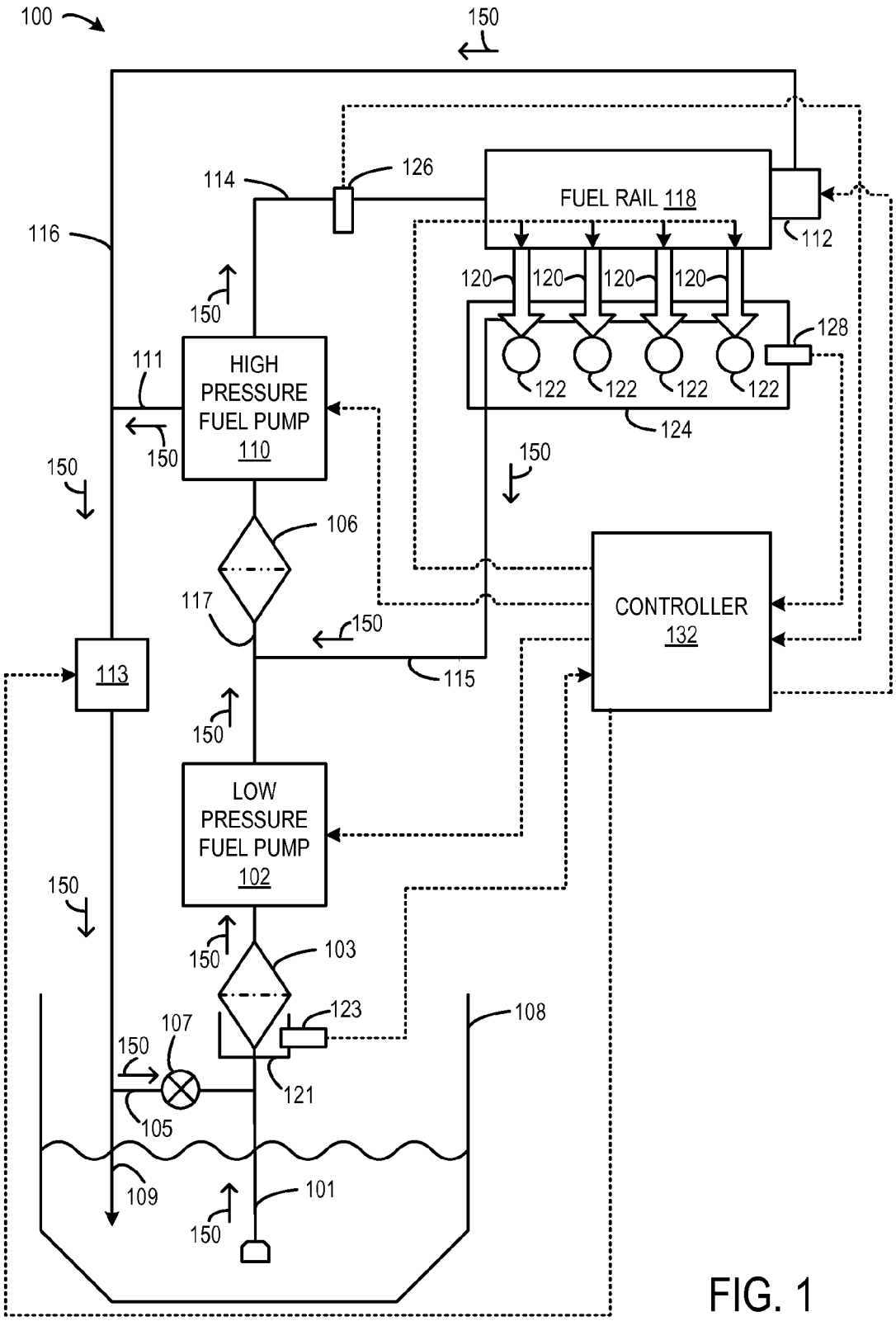
FIG. 1 shows a schematic diagram of an example fuel delivery and fuel return system, according to an embodiment of the present disclosure.

FIG. 1 shows a schematic depiction of a fuel delivery system 100 for an internal combustion engine, such as a diesel engine, for use in a vehicle. As shown, fuel may be delivered through fuel delivery system 100 through various fuel lines and through various different components in a direction as indicated generally by arrows 150.

Fuel delivery system 100 includes a low-pressure fuel pump 102 to pump liquid fuel from fuel tank 108. In this embodiment, fuel pump 102 is an electronically controlled variable speed lift pump. In some cases, low-pressure fuel pump 102 may only operate at a limited number of speeds.

Figure 2:
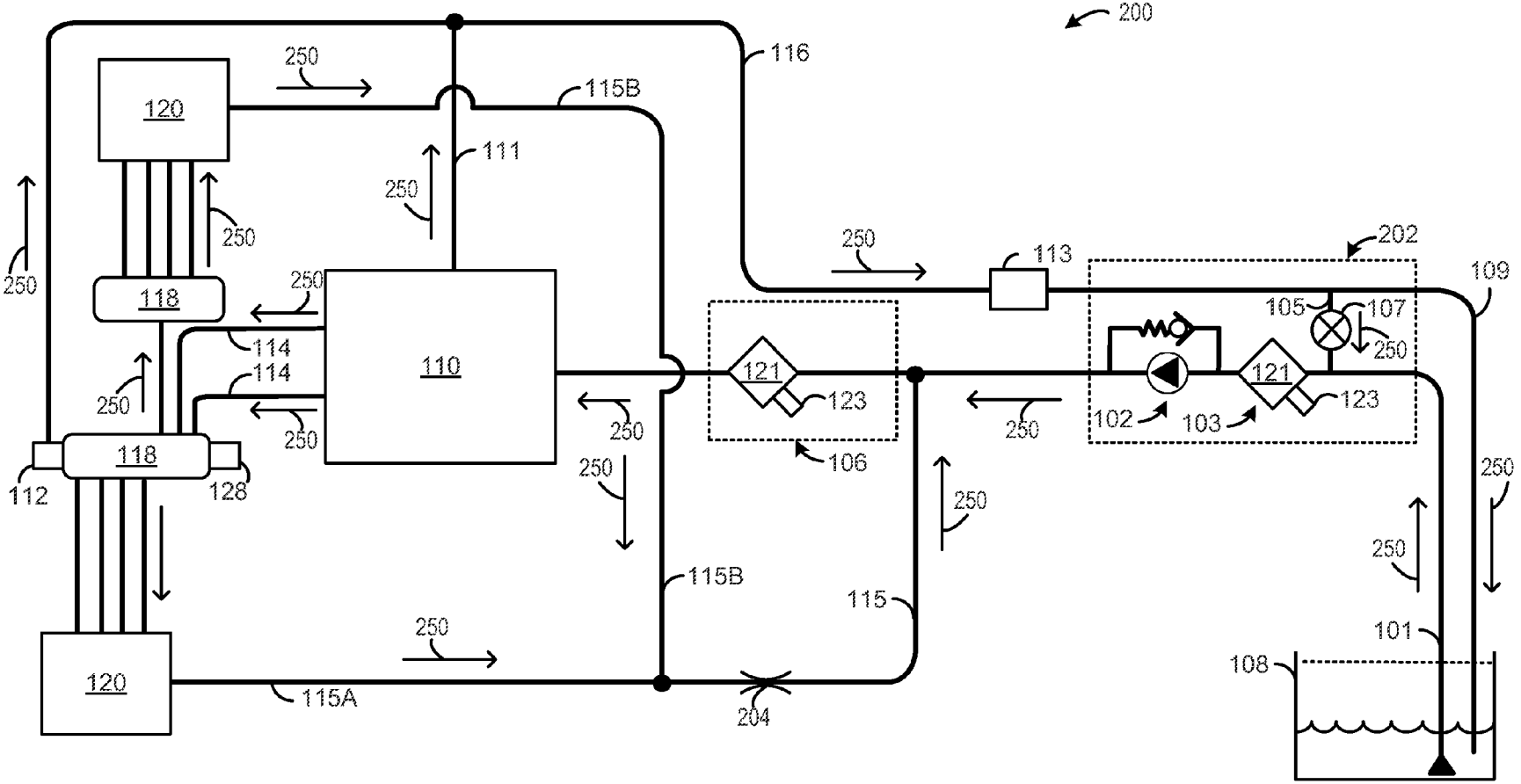
FIG. 2 shows a schematic diagram of the example fuel delivery and fuel return system of FIG. 1 including further details, according to an embodiment of the present disclosure.

A first fuel filter 103 is disposed upstream of the low-pressure fuel pump 102 in low pressure pump intake line 101. First fuel filter 103 may remove larger impurities that may be contained in the fuel that could potentially damage vital engine components. For example, the first fuel filter may have a 10 μm filtration size. Further, as best shown in FIG. 2, the first fuel filter includes a water separator and a water in fuel (WIF) reservoir 121, which may be manually drained. A WIF sensor 123 is coupled to WIF reservoir 121 and signals to the controller 132 when the water level in the reservoir is above a predetermined level. When the water level in the reservoir is above the predetermined level, an operator of the vehicle may receive a warning/signal from controller 132, indicating that WIF reservoir 121 should be drained. In alternate embodiments, the first fuel filter may have a different filtration size and/or the first fuel filter may not include a water separator and a WIF reservoir/sensor.

Low-pressure fuel pump 102 is fluidly coupled to a second fuel filter 106. Second fuel filter 106 may remove smaller impurities that may be contained in the fuel that could potentially damage vital engine components. For example, the second fuel filter 106 may have a 2-4 μm filtration size. Further, in one embodiment, the second fuel filter may have water separation capacity until the filter is saturated. Thus, in this example, the second fuel filter is a disposable one-piece filter. In alternate embodiments, the second fuel filter may have a different filtration size and/or the filter may not be a disposable one-piece filter.

Fuel may be delivered from second fuel filter 106 to high-pressure fuel pump 110. High-pressure fuel pump 110 may increase the pressure of fuel received from the second fuel filter from a first pressure level generated by low-pressure fuel pump 102 to a second pressure level higher than the first level. High-pressure fuel pump 110 may deliver high pressure fuel to fuel rail 118 via fuel line 114. Operation of high-pressure fuel pump 110 may be adjusted based on operating conditions of the vehicle. For example, the high-pressure fuel pump may be alternately operated in a pressure control mode (during engine cold start) and a volume control mode (during operation when fuel temperature is above a threshold, such as 20° C.).

Fuel pressure regulator 112 may be coupled in line with fuel line 114 to regulate fuel delivered to fuel rail 118 at a set-point pressure. It will be appreciated that operation of fuel pressure regulator 112 may be adjusted to change the fuel pressure set-point to accommodate operating conditions. To regulate the fuel pressure at the set-point, fuel pressure regulator 112 may return excess fuel via a first return line 116. First return line 116 may return excess fuel to either of the fuel supply 108 (via line 109) and/or a location in the low pressure pump intake line 101 upstream of the first fuel filter 103 (via cross over line 105).

Opening and closing of cross over line 105 is regulated by valve 107. In the present embodiment, valve 107 is a thermal re-circulation valve, which may be fully open at 75-80° F. and fully closed at 100° F. Thus, when fuel has a temperature greater than 100° F., fuel may be directed to the fuel supply 108, and when fuel has a temperature less than 80° F., more fuel may be directed to the low pressure pump intake line 101. At temperatures between 80° F. and 100° F. fuel may be directed to both of the fuel supply 108 and the low pressure pump intake line 101, with less fuel directed to the low pressure pump intake line 101. In an alternate embodiment, valve 107 may include a temperature sensor and opening of the valve may be regulated by controller 132. First fuel return line 116 additionally includes a fuel cooler 113, operation of which is regulated by controller 132. In another alternate embodiment, fuel system 100 may not include a fuel cooler.

A second return line 111 directs excess fuel from the high pressure pump 110 to first return line 116. In the present embodiment, second fuel return line 111 is coupled to first return line 116 at a location upstream of the fuel cooler 113. In alternate embodiments the second return line may have an alternate arrangement. For example, the second return line may not be coupled to the first return line, and instead may be couple directly to the fuel supply and/or another region of the lower pressure fuel system. In another example, the second return line may be coupled to the first return line at a location downstream of the fuel cooler or to a third return line 115 (described below).

Fuel rail 118 may distribute fuel to each of a plurality of fuel injectors 120. Each of the plurality of fuel injectors 120 may be positioned in a corresponding cylinder 122 of engine 124 such that during operation of fuel injectors 120 fuel is injected directly into each corresponding cylinder 122. Further, the plurality of fuel injectors 120 are coupled to a third return line 115. Third return line 115 may return excess fuel from the plurality of fuel injectors 120 to a high pressure pump intake line 117, at a location upstream of the second fuel filter 106.

Alternatively (or in addition), engine 124 may include fuel injectors positioned at the intake port of each cylinder such that during operation of the fuel injectors, fuel is injected into the intake port of each cylinder. In, the illustrated embodiment, engine 124 includes four cylinders. However, it will be appreciated that the engine may include a different number of cylinders.

Controller 132 may receive various signals from sensors coupled to fuel delivery system 100 and engine 124. For example, controller 132 may receive a fuel pressure (and/or temperature) signal from fuel sensor 126, which in the present embodiment is positioned downstream of high-pressure fuel pump 110 (e.g. positioned in fuel line 114). In alternate embodiments, fuel sensor 126 may be mounted in any location between or on the high-pressure pump and the fuel rail. In some cases, fuel pressure measured by fuel sensor 126 may be indicative of a fuel rail pressure. In some embodiments, a fuel sensor may be positioned upstream from high-pressure fuel pump 110 to measure a pressure of fuel exiting low-pressure fuel pump 102. Further, controller 132 may receive engine/exhaust parameter signals from engine sensor(s) 128. For example, these signals may include measurement of inducted mass air flow, engine coolant temperature, engine speed, throttle position, absolute manifold pressure, emission control device temperature, etc. Note that various combinations of the above measurements as well as measurements of other related parameters may be sensed by sensor(s) 128. It will be appreciated that the controller may receive other signals indicative of vehicle operation.

Controller 132 may provide feedback control based on signals received from fuel sensor 126, engine sensor(s) 128, among others. For example, controller 132 may send signals to adjust a current level or pulse width of a mechanical solenoid valve (MSV) of high-pressure fuel pump 110 to adjust operation of high-pressure fuel pump 110, a fuel pressure set-point of fuel pressure regulator 110, and/or a fuel injection amount and/or timing based on signals from fuel sensor 126 and/or engine sensor(s) 128.

In one example controller 132 is a microcomputer that includes a microprocessor unit, input/output ports, an electronic storage medium for executable programs and calibration values such as read only memory, random access memory, keep alive memory, and a data bus. The storage medium read-only memory can be programmed with computer readable data representing instructions executable by the processor for performing the method described below as well as other variants that are anticipated but not specifically listed.

It will be appreciated that fuel delivery system 100 is provided by way of example, and thus, is not meant to be limiting. Therefore, fuel delivery system 100 may include additional and/or alternative components than those illustrated in FIG. 1 without departing from the scope of this disclosure.

FIG. 2 shows a fuel delivery system 200, which may be similar to fuel delivery system 100. As shown, fuel may be delivered through fuel delivery system 200 through various fuel lines and through various different components in a direction as indicated generally by arrows 250, similar to fuel delivery system 100.

It will be appreciated that FIG. 2 shows fuel delivery system 200, which may be similar to fuel delivery system 100. As such, similar components are referenced with like numbers. Further, it is to be understood that some components may differ to some degree.

For example, first fuel filter 103, low pressure pump 102, and cross over line 105 including thermal circulation valve 107 may comprise a diesel fuel conditioning module (DFCM) 202. Thus, DFCM 202 may include portions of intake line 101 and first return line 116 (and/or fuel line 109).

Further, fuel delivery system 200 may be configured for two separate fuel rails 118. For example, a V-configuration engine may have two fuel rails. Likewise, fuel delivery system 200 may include a third fuel return line 115A and a third fuel return line 115B that converge to third return line 115, as shown. Further still, fuel delivery system 200 may include a one piece throttle valve 204. Throttle valve 204 may be positioned within third return line 115 at a position downstream from the convergence of third return line 115A and 115B, for example. However, it will be appreciated that throttle valve 204 may be in another position without departing from the scope of this disclosure.

It will be appreciated that fuel delivery system 200 is provided by way of example, and thus, is not meant to be limiting. Therefore, fuel delivery system 200 may include additional and/or alternative components than those illustrated in FIG. 2 without departing from the scope of this disclosure.

For example, it is to be understood that high pressure pump 110 may be various high pressure pumps, and thus may have various configurations without departing from the scope of this disclosure. For example, the high pressure pump may include internal components that have an internal (high pressure pump) low pressure. Further, the high pressure pump may include high pressure fuel lines coupled to fuel rails 118. Other lines and components in fuel delivery system 200 may have a vehicle low pressure. For example, the vehicle low pressure may be lower than the internal low pressure of the high pressure pump. In another example, the internal low pressure of the high pressure pump may be lower than the vehicle low pressure. Further still, the high pressure fuel lines downstream from the high pressure pump may be higher in pressure than the internal low pressure and the vehicle low pressure, for example.

Figure 3:
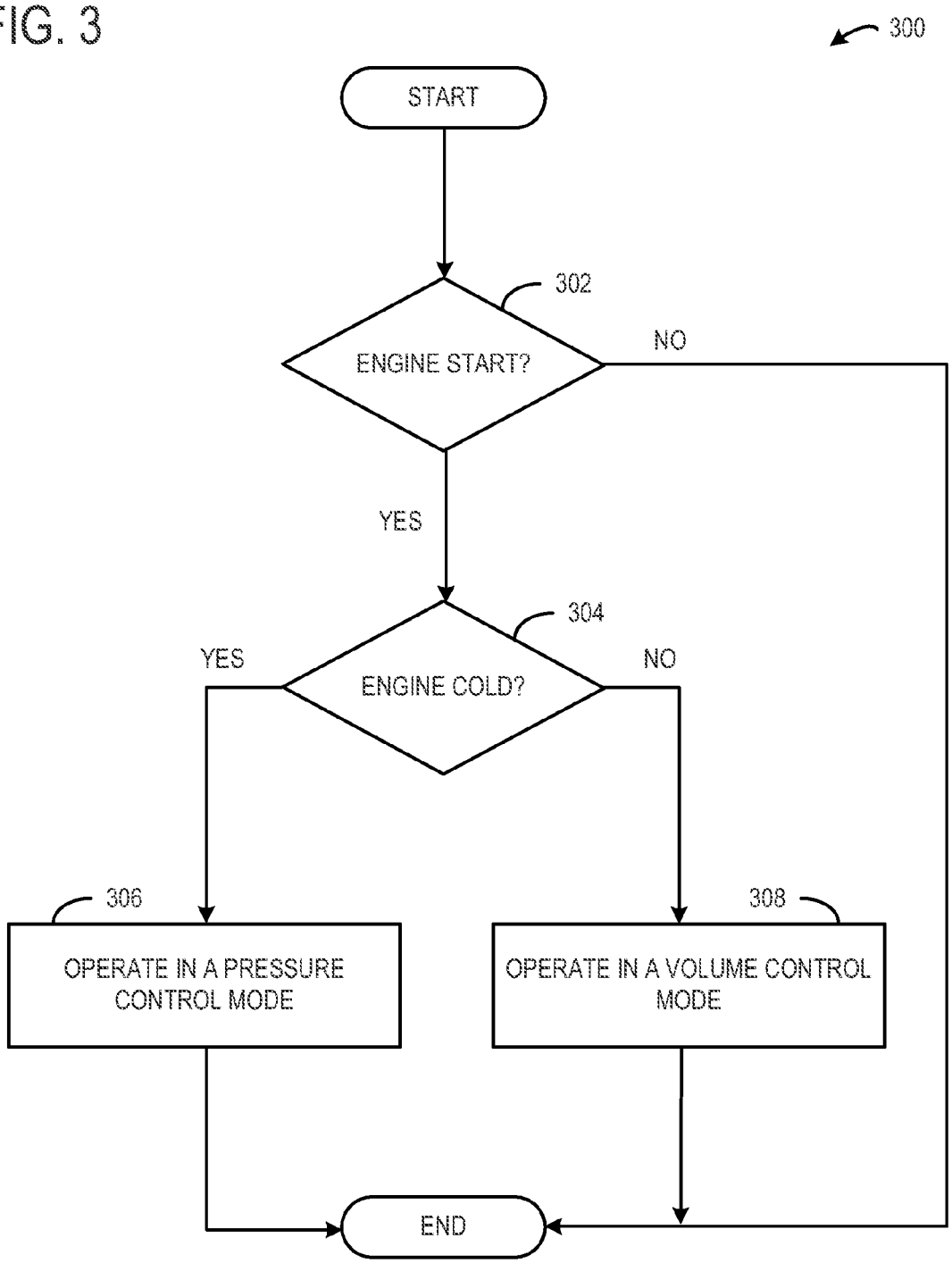
FIG. 3 shows a flowchart illustrating an example method for delivering fuel using the fuel return system of FIG. 1 according to an embodiment of the present disclosure.

FIG. 3 shows an example method 300 for controlling fuel delivery using the fuel system described above. At 302, method 300 includes determining if the engine starts. If the answer to 302 is YES, the method continues to 304. If the answer to 302 is NO, the method ends.

At 304, method 300 includes determining if the engine is cold. For example, a cold engine may also indicate that a fuel temperature is below a threshold temperature. As one example, the threshold temperature may be 20° C. If the answer to 304 is YES, the method continues to 306. For example, if a sensor senses a fuel temperature at or below 20° C. then it may be determined that the engine is cold. If the answer to 304 is NO, the method continues to 308. For example, if a sensor senses a fuel temperature above 20° C. then it may be determined that the engine is not cold.

At 306, method 300 includes operating a fuel system in a pressure control mode. For example, the pressure control mode may include actuating a fuel pressure regulator to return fuel via a first return line. Further, the fuel returned via such a line may be returned upstream from a thermal recirculation valve, as described above. Thus, returned fuel may be returned to the tank, or may be returned to a position upstream from the first fuel filter via a cross over line, as described above.

At 308, method 300 includes operating a fuel system in a volume control mode. For example, the volume control mode may include diverting excess fuel away from a plurality of fuel injectors and/or a way from a high pressure fuel pump in order to maintain a predetermined fuel pressure. As such, fuel may be returned via a second return line and/or a third return line, as described above. Thus, fuel may be diverted to the first return line and/or to a position upstream from the high pressure pump, for example.

It will be appreciated that method 300 is provided by way of example, and thus, is not meant to be limiting. Therefore, it is to be understood that method 300 may include additional and/or alternative steps than those illustrated in FIG. 3 without departing from the scope of this disclosure. Further, it is to be understood that method 300 may be performed in any suitable order. Further still, it is to be understood that one or more steps illustrated in FIG. 3 may be omitted without departing from the scope of this disclosure.

The above described fuel system may be provided to improve engine operation. For example, return fuel directed to the low pressure pump 102 via cross over line 105 may boost pressure during cold start conditions and prevent injector collapse. In another example, warm return fuel directed to the low pressure pump intake line 101 may prevent gellation of fuel and clogging of the fuel system at the first fuel filter 103 and/or the low pressure pump 102. Further, if return fuel is at a temperature that may damage the first fuel filter 103 and/or the low pressure fuel pump 102, such as a temperature above 100° F., the fuel cooler 113 may be used to cool the return fuel, and/or the thermal re-circulation valve may close and direct return fuel to the fuel supply 108, where hot return fuel will mix with colder bulk fuel. Thus, damage to the fuel system from over-heated fuel may be prevented. In yet another example, return fuel from the plurality of injectors

120 may warm cold fuel in the region of second fuel filter 106 and high pressure pump 110, thus preventing gellation of fuel and clogging of the fuel system at the second fuel filter and the high pressure pump. In even another example, inclusion of multiple progressively finer filters (first fuel filter 103 and second fuel filter 106) upstream of each fuel pump in the fuel system improves removal of debris and the efficiency and life of fuel pumps.

It will be appreciated that the configurations and routines disclosed herein are exemplary in nature, and that these specific embodiments are not to be considered in a limiting sense, because numerous variations are possible. For example, the above technology can be applied to V-6, V-12, and other engine types. The subject matter of the present disclosure includes all novel and nonobvious combinations and subcombinations of the various systems and configurations, and other features, functions, and/or properties disclosed herein. For example, a fuel system may include more fuel pumps, an electronically-controlled fuel pressure regulator having a variable fuel pressure set-point coupled downstream of at least one of the fuel pumps, and a pressure delay device coupled downstream of the fuel pressure regulator.

The invention claimed is:

1. A system for an engine, comprising:

a fuel supply coupled to a low pressure fuel pump, the low pressure fuel pump coupled to a high pressure fuel pump to provide fuel to a fuel rail;

a pressure regulator coupled to the fuel rail;

a plurality of injectors coupled to the fuel rail;

a fuel return system, comprising:

a first fuel return line coupling the fuel rail to the fuel supply via the pressure regulator;

a cross-over line including a first end coupled to the first fuel return line at a position upstream of the fuel supply, a second end coupled to a low pressure fuel pump intake line at a position downstream of a low pressure fuel pump intake line inlet, and a thermal recirculation valve at a position between the first end and the second end;

a second fuel return line coupling the high pressure fuel pump to the first fuel return line; and a third fuel return line, separate from the first fuel return line, coupling the plurality of injectors to a high pressure fuel pump intake line; and a controller with read-only memory that includes computer readable data representing instructions for:

in response to a fuel temperature below a threshold temperature, adjusting the pressure regulator to deliver fuel from the fuel rail to each of the fuel supply and the low pressure fuel pump intake line at the position downstream of the low pressure fuel pump intake line inlet, said adjusting based on each of the fuel temperature and a pressure within the fuel rail, and providing pressurized fuel to a return side of the plurality of fuel injectors via the third fuel return line and the low pressure fuel pump; and in response to a fuel temperature above the threshold temperature, diverting excess fuel away from the plurality of fuel injectors to the high pressure fuel pump intake line via the third fuel return line, and away from the high pressure fuel pump to the first fuel return line via the second fuel return line.

2. The system of claim 1, wherein the thermal recirculation valve is fully open at temperatures greater than 100° F. and is fully closed at temperatures less than 75° F.

3. The system of claim 1, further comprising a first fuel filter disposed in the low pressure pump intake line, such that return fuel is directed to the low pressure pump intake line upstream of the first fuel filter.

4. The system of claim 3, further comprising a second fuel filter disposed in the high pressure fuel pump intake line, such that return fuel is directed to the high pressure fuel pump intake line upstream of the second fuel filter.

5. The system of claim 4, wherein the first fuel filter has a first filtration size and the second fuel filter has a second filtration size, the second filtration size finer than the first filtration size.

6. The system of claim 3, wherein the first fuel filter includes a water separator and a water in fuel reservoir.

7. The system of claim 6, wherein the first fuel filter further includes a sensor coupled to the water in fuel reservoir, the sensor configured to provide a signal to the controller when a water level in the water in fuel reservoir is above a predetermined level.

8. A multi-staged fuel system, comprising:

a fuel supply;

a low pressure fuel pump coupled to the fuel supply;

a first fuel filter disposed between the low pressure fuel pump and the fuel supply;

a high pressure fuel pump;

a second fuel filter disposed between the high pressure fuel pump and the low pressure fuel pump;

a common fuel rail downstream of the high pressure fuel pump;

a pressure control valve coupling the common fuel rail to a first fuel return line that directs return fuel to each of the fuel supply and a low pressure fuel pump intake line at a location upstream of the first fuel filter and downstream from a low pressure fuel pump intake line inlet;

a second fuel return line directing fuel from the high pressure fuel pump to the first fuel return line at a location downstream of the pressure control valve;

a plurality of injectors directly coupled to a third fuel return line, different from the first fuel return line, that returns excess fuel from the plurality of injectors coupled to a high pressure fuel pump intake line at a location upstream of the second fuel filter, the high pressure fuel pump intake line starting at the low pressure fuel pump and ending at the high pressure fuel pump; and a controller with read-only memory that includes computer readable data representing instructions for:

in response to a fuel temperature below a threshold temperature, adjusting the pressure control valve to deliver fuel from the common fuel rail to each of the fuel supply and the low pressure fuel pump intake line at the location upstream of the first fuel filter and downstream from the low pressure fuel pump intake line inlet, said adjusting based on each of the fuel temperature and a pressure within the common fuel rail, and providing pressurized fuel to a return side of the plurality of injectors via the third fuel return line and the low pressure fuel pump; and in response to a fuel temperature above the threshold temperature, diverting excess fuel away from the plurality of injectors to the high pressure fuel pump intake line via the third fuel return line, and away from the high pressure fuel pump to the first fuel return line via the second fuel return line.

9. The multi-staged fuel system of claim 8, wherein the first fuel filter has a first filtration size and the second fuel filter has a second filtration size, the second filtration size finer than the first filtration size.

10. The multi-staged fuel system of claim 8, wherein the first fuel return line includes a thermal recirculation valve which is coupled to the low pressure fuel pump intake line.

11. The multi-staged fuel system of claim 10, wherein the thermal recirculation valve is fully open at temperatures greater than 100° F. and is fully closed at temperatures less than 75° F.

12. The multi-staged fuel system of claim 11, wherein return fuel bypasses the fuel supply when the thermal recirculation valve is open, and wherein return fuel enters the fuel supply when the thermal recirculation valve is closed.

13. A fuel system, comprising:

a fuel supply;

a low pressure fuel pump coupled to the fuel supply;

a high pressure fuel pump downstream from the low pressure fuel pump; and a common rail direct injection system downstream from the high pressure fuel pump, the common rail direct injection system including:

a common rail;

a fuel pressure regulator that returns fuel to each of the fuel supply and a low pressure fuel pump intake line at a position downstream of a low pressure fuel pump intake line inlet, and a plurality of fuel injectors that return fuel to a location along a fuel line coupling the low pressure fuel pump and the high pressure fuel pump; and a controller with read-only memory that includes computer readable data representing instructions for:

in response to a fuel temperature below a threshold temperature, adjusting the fuel pressure regulator to return fuel from the common rail to each of the fuel supply and the low pressure fuel pump intake line at the position downstream of the low pressure fuel pump intake line inlet, said adjusting based on each of the fuel temperature and a pressure within the common rail, and providing pressurized fuel from the fuel line coupling the low pressure fuel pump and the high pressure fuel pump to a return side of the plurality of fuel injectors; and in response to a fuel temperature above the threshold temperature, diverting excess fuel away from the plurality of fuel injectors to the fuel line coupling the low pressure fuel pump and the high pressure fuel pump, and away from the high pressure fuel pump to the each of the fuel supply and the low pressure fuel pump intake line at a position downstream of the low pressure fuel pump intake line inlet.

14. The fuel system of claim 13, wherein the high pressure fuel pump and the common rail direct injection system return fuel to a location downstream of the low pressure fuel pump.

15. The fuel system of claim 14, further comprising a thermal recirculation valve provided in a cross over line that couples the low pressure fuel pump intake line to a fuel return line, wherein the thermal recirculation valve is fully open at temperatures greater than 100° F. enabling return fuel to bypass the fuel supply and is fully closed at temperatures less than 75° F. allowing return fuel to enter the fuel supply.

16. The fuel system of claim 13, wherein the high pressure fuel pump and the common rail direct injection system return fuel to the fuel supply.

17. The fuel system of claim 13, further comprising a fuel filter positioned between the low pressure fuel pump and the fuel supply.

18. The fuel system of claim 13, further comprising a fuel filter positioned between the high pressure fuel pump and the low pressure fuel pump upstream from an injector return passage that returns fuel from the plurality of fuel injectors to the location along the fuel line, the fuel filter positioned downstream from the location.

* * * * *